US006177397B1

(12) United States Patent
Staley

(10) Patent No.: US 6,177,397 B1
(45) Date of Patent: Jan. 23, 2001

(54) FREE-FLOWING AGGLOMERATED NONIONIC SURFACTANT DETERGENT COMPOSITION AND PROCESS FOR MAKING SAME

(75) Inventor: David Scott Staley, Rockford, MI (US)

(73) Assignee: Amway Corporation, Ada, MI (US)

( * ) Notice: Under 35 U.S.C. 154(b), the term of this patent shall be extended for 0 days.

(21) Appl. No.: 09/142,900

(22) PCT Filed: Mar. 10, 1997

(86) PCT No.: PCT/US97/03741

§ 371 Date: Dec. 17, 1998

§ 102(e) Date: Dec. 17, 1998

(87) PCT Pub. No.: WO97/33959

PCT Pub. Date: Sep. 18, 1997

(51) Int. Cl.[7] ..... C11D 11/00

(52) U.S. Cl. ..... 510/444; 510/349; 510/351; 510/356; 510/361; 510/438; 510/441; 510/488; 510/509

(58) Field of Search ..... 510/108, 276, 510/349, 351, 356, 361, 438, 441, 444, 488, 509

(56) References Cited

U.S. PATENT DOCUMENTS

| | | |
|---|---|---|
| 3,446,893 | 5/1969 | Hanford et al. . |
| 3,579,455 | 5/1971 | Sabatelli et al. . |
| 3,597,361 | 8/1971 | Sumner . |
| 3,627,686 | 12/1971 | Sabatelli et al. . |
| 3,653,914 | 4/1972 | Schmitt . |
| 3,664,961 | 5/1972 | Norris . |
| 3,684,744 | 8/1972 | Shen et al. . |
| 3,700,599 | 10/1972 | Mizuno et al. . |
| 3,761,415 | 9/1973 | Gould . |
| 3,764,559 | 10/1973 | Mizuno et al. . |
| 3,769,222 | 10/1973 | Yurko et al. . |
| 3,799,880 | 3/1974 | Kelly et al. . |
| 3,801,511 | 4/1974 | Lemoff . |
| 3,850,852 | 11/1974 | Neillie et al. . |
| 3,886,098 | 5/1975 | DiSalvo et al. . |
| 3,896,056 | 7/1975 | Benjamin et al. . |
| 3,904,685 | 9/1975 | Shahidi et al. . |
| 3,920,586 | 11/1975 | Bonaparte et al. . |
| 3,922,230 | 11/1975 | Lamberti et al. . |
| 3,933,670 | 1/1976 | Brill et al. . |
| 3,933,673 | 1/1976 | Davies . |
| 3,950,260 | 4/1976 | Eldib . |
| 3,950,275 | 4/1976 | Toyoda et al. . |
| 3,962,149 | 6/1976 | Chirash et al. . |
| 3,993,574 | 11/1976 | Christ et al. . |
| 4,049,467 | 9/1977 | Rubin . |
| 4,051,054 | 9/1977 | Davies et al. . |
| 4,059,538 | 11/1977 | Green et al. . |
| 4,098,713 | 7/1978 | Jones . |
| 4,125,475 | 11/1978 | Kolaian et al. . |
| 4,140,650 | 2/1979 | Wilde . |
| 4,180,467 | 12/1979 | Barth . |
| 4,196,093 | 4/1980 | Clarke et al. . |
| 4,203,858 | 5/1980 | Chakrabarti . |
| 4,210,550 | 7/1980 | Cornelissens . |
| 4,216,104 | 8/1980 | Gergely . |
| 4,222,905 | 9/1980 | Cockrell, Jr. . |
| 4,234,442 | 11/1980 | Cornelissens . |
| 4,239,659 | 12/1980 | Murphy . |
| 4,248,911 | 2/1981 | Wixon . |
| 4,272,393 | 6/1981 | Gergely . |
| 4,294,718 | 10/1981 | Kaeser . |
| 4,298,493 | 11/1981 | Schreiber . |
| 4,311,606 | 1/1982 | Kaeser . |
| 4,311,607 | 1/1982 | Kaeser . |
| 4,362,640 | 12/1982 | Schreiber . |
| 4,407,722 | 10/1983 | Davies et al. . |
| 4,416,809 | 11/1983 | Magari et al. . |
| 4,441,881 | 4/1984 | Ruppert et al. . |
| 4,444,674 | 4/1984 | Gray . |
| 4,473,485 | 9/1984 | Greene . |
| 4,524,013 | 6/1985 | Lamberti . |
| 4,534,876 | 8/1985 | Browne . |
| 4,557,853 | 12/1985 | Collins . |
| 4,589,989 | 5/1986 | Müller et al. . |
| 4,612,137 | 9/1986 | Kuroda et al. . |
| 4,619,710 | 10/1986 | Kuenn et al. . |
| 4,652,391 | 3/1987 | Balk . |
| 4,664,836 | 5/1987 | Taylor, Jr. et al. . |
| 4,666,740 | 5/1987 | Wixon . |
| 4,715,980 | 12/1987 | Lopes et al. . |
| 4,720,399 | 1/1988 | Taha . |
| 4,741,851 | 5/1988 | Borrello . |
| 4,806,173 | 2/1989 | Toukan . |
| 4,818,424 | 4/1989 | Evans et al. . |
| 4,820,441 | 4/1989 | Evans et al. . |
| 4,853,259 | 8/1989 | Taha . |
| 4,857,223 | 8/1989 | Borrello . |

(List continued on next page.)

FOREIGN PATENT DOCUMENTS 0 110 588 6/1984 (EP) .

OTHER PUBLICATIONS

Prieto et al., United States Statutory Invention Registration, Reg. No. H1467, Publication Date: Aug. 1, 1995.

*Primary Examiner*—Lorna M. Douyon
(74) *Attorney, Agent, or Firm*—Brinks Hofer Gilson & Lione; G. Peter Nichols

(57) ABSTRACT

A free-flowing agglomerated powder detergent process and the resulting composition includes from about 5% to about 80% of an alkali metal carbonate; from about 5% to about 50% of a detergent surfactant, and, up to about 25% of an alkali metal salt of a carboxylic acid, wherein the carboxylic acid is selected from the group of carboxylic acids that, below a first temperature, have a greater water solubility than the water solubility of its corresponding alkali-metal salt. The alkali metal salt is preferably provided solely by the reaction of (a) a premix comprising the alkali metal carbonate coated with the surfactant (b) a carboxylic acid selected from the group consisting of citric acid, malic acid, and mixtures thereof, and (c) water.

6 Claims, No Drawings

U.S. PATENT DOCUMENTS

| | | | | |
|---|---|---|---|---|
| 4,869,843 | | 9/1989 | Saito et al. . | |
| 4,879,105 | | 11/1989 | Yorozu . | |
| 4,900,466 | | 2/1990 | Atkinson et al. . | |
| 4,919,847 | | 4/1990 | Barletta et al. . | |
| 4,923,628 | | 5/1990 | Appel et al. . | |
| 4,931,203 | | 6/1990 | Ahmed et al. . | |
| 4,954,292 | | 9/1990 | Hull et al. . | |
| 4,970,017 | | 11/1990 | Nakamura et al. . | |
| 4,992,079 | | 2/1991 | Lutz . | |
| 5,002,758 | | 3/1991 | Ichii et al. . | |
| 5,030,377 | | 7/1991 | Sone et al. . | |
| 5,030,379 | | 7/1991 | Knight et al. . | |
| 5,091,106 | | 2/1992 | Jacobs et al. . | |
| 5,114,647 | * | 5/1992 | Levesque et al. | 264/115 |
| 5,133,924 | | 7/1992 | Appel et al. . | |
| 5,164,108 | | 11/1992 | Appel et al. . | |
| 5,198,144 | | 3/1993 | Ichii et al. . | |
| 5,259,994 | | 11/1993 | Welch et al. . | |
| 5,279,756 | | 1/1994 | Savio et al. . | |
| 5,300,250 | | 4/1994 | Morgan et al. . | |
| 5,312,561 | | 5/1994 | Hoshino et al. . | |
| 5,312,748 | | 5/1994 | Liu et al. . | |
| 5,314,637 | | 5/1994 | Saito et al. . | |
| 5,338,476 | | 8/1994 | Pancheri et al. . | |
| 5,415,806 | | 5/1995 | Pepe et al. . | |
| 5,458,799 | | 10/1995 | Flower . | |
| 5,468,416 | | 11/1995 | Outtrup et al. . | |
| 5,468,516 | | 11/1995 | Yamashita et al. . | |
| 5,470,509 | | 11/1995 | Pancheri . | |
| 5,496,486 | | 3/1996 | Staley . | |
| 5,635,467 | * | 6/1997 | Staley | 510/349 |

* cited by examiner

FREE-FLOWING AGGLOMERATED NONIONIC SURFACTANT DETERGENT COMPOSITION AND PROCESS FOR MAKING SAME

BACKGROUND OF THE INVENTION

1. Field of the Invention

The present invention relates to a free-flowing agglomerated powder detergent containing high levels of nonionic surfactant and a process for making the same.

2. Discussion of Related Art

There is an on-going effort to provide powdered laundry detergents having an increased amount of detergent surfactants. The benefits of highly concentrated detergents include a savings in packaging use and cost. Unfortunately, there are limits to the amount of detergent surfactant that can be included in a powdered detergent while still providing the consumer desired characteristics of flowability, solubility, cleaning and whitening performance.

Most granular detergents are produced by spray drying. This process involves mixing detergent components such as surfactants and builders with water to form a slurry which is then sprayed into a high temperature air stream to evaporate excess water and to form bead-type hollow particles. While spray drying the detergent slurry produces a hollow granular detergent having an excellent solubility, extremely large amounts of heat energy are needed to remove the large amounts of water present in the slurry. Another disadvantage of the spray drying process is that because large scale production equipment is required, a large initial investment is necessary. Further, because the granules obtained by spray drying have a low bulk density, the granule packaging volume is large which increases costs and paper waste. Also, the flowability and appearance of the granules obtained by spray drying may be poor because of the presence of large irregularities on the surface of the granules.

In addition to these characteristic processing and product problems associated with the spray drying process, volatile materials, such as nonionic surfactants, are emitted into the air when processed by this method. This volatilization problem, manifested by the discharge of dense "blue" smoke from the spray tower, is referred to as "pluming." Air pollution standards limit the opacity of the plume. Consequently, it is necessary to limit the capacity of the spray tower or, in extreme instances, discontinue operation.

In an attempt to avoid the problems caused by spray drying, considerable developmental effort has focused on post-dosing the product with nonionic surfactants after the spray drying operation. Unfortunately, post-dosing of the spray dried base with surfactant in amounts sufficient to provide satisfactory wash performance generally results in a product that has poor dissolution characteristics. Accordingly, the amount of surfactant that may be employed in the detergent formulation is severely limited. Because heavy-duty laundry detergents need large amounts of nonionic surfactant present, inorganic silicates have been added to these detergent formulations to absorb the nonionic liquids.

For example, U.S. Pat. No. 3,769,222 to Yurko et al. discloses mixing liquid nonionic surfactants with sodium carbonate until partial solidification occurs followed by the addition of large amounts of silica (silicon dioxide) to produce a dry free-flowing detergent composition. A disadvantage to this technique, however, is that because the silica has no significant cleaning activity, its inclusion in a detergent formulation in large amounts merely serves to increase the cost of the product. Further, the use of silica in detergents adds to the total suspended solids (TSS) content of laundry waste water contrary to the dictates of many local and state water pollution standards. Therefore, there is an incentive to keep low the amount of silica added to the detergent composition.

U.S. Pat. No. 4,473,485 to Greene reports that a free-flowing granular detergent can be prepared by mixing a polycarboxylic structuring agent solution with a micronized carbonate followed by the addition to the mixture of a nonionic surfactant and water, followed by removal of the excess water. The preferred micronized carbonate is calcium or sodium carbonate. A disadvantage of this process, however, is that the micronized carbonate used by Greene to enhance the flowability of the detergent product is quite expensive as compared to standard sodium carbonate. Without the use of the micronized carbonate, Greene's product would not have such good flowability. In addition, where the micronized carbonate is calcium carbonate, the building capability of the detergent is reduced.

Therefore, a need exists for a process and its resulting composition that substantially overcomes the problem of free-flowability in highly loaded nonionic detergents.

SUMMARY OF THE INVENTION

The present invention relates to a free-flowing agglomerated detergent powder that contains a high level of nonionic detergent surfactant and a process for making it. More broadly, the present invention relates to a free flowing agglomerated detergent powder that contains high levels of detergent surfactants and a process for making the free flowing detergent powder. The present invention also relates to a process for making a free-flowing agglomerated detergent powder, particularly one that contains a high level of nonionic detergent surfactant. The method includes the steps of loading an alkali metal carbonate with a surfactant selected from the group consisting of anionics, nonionics, ampholytics, cationics, zwitterionics, and mixtures thereof to form a homogeneous coated alkali metal carbonate premix; admixing a carboxylic acid into the premix; introducing water onto the mixture; and agitating the mixture to accomplish agglomeration. Preferably, the mixture is fed to a rotating agglomerator where a minor amount of water is sprayed into the mixture as the agglomerator rotates. The agglomerate is preferably dried to remove the excess water, i.e., water not bound as the hydrate, to form the free-flowing detergent composition of the present invention.

Optionally, minor amounts of other known detergent ingredients may be present in the premix. For example, minor amounts of silicas and carboxymethylcellulose can be mixed with the alkali metal carbonate prior to being loaded with the surfactant.

Preferably, the process includes loading sodium carbonate with a surfactant to form a homogeneous surfactant coated alkali metal carbonate premix. The surfactant is selected from the group consisting of anionics, nonionics, zwitterionics, ampholytics, cationics, and mixtures thereof. Preferably, the surfactant is a nonionic surfactant. A carboxylic acid that is selected from the group of carboxylic acids that, below a first temperature, have a greater water solubility than the water solubility of Its corresponding alkali-metal salt is admixed with the premix to form a mixture. As will be discussed below, the first temperature is from about 15° C. to about 40° C. Preferably, the carboxylic acid is selected from the group consisting of citric acid, malic acid, and mixtures thereof. The mixture is agitated while a minor amount of water, less than about 7%, is incorporated into the mixture causing the carboxylic acid to solubilize and neutralize forming the sodium salt of the carboxylic acid and causing the mixture to agglomerate. The agglomerated mixture is dried to remove at least about 50% of the added water to form a free-flowing powder detergent composition.

The resulting agglomerated detergent comprises an alkali metal carbonate present in about 5% to about 80% weight of the final product; a detergent surfactant, preferably, a nonionic detergent surfactant present in about 5% to about 50% by weight of the final product; and up to about 25% of an alkali metal salt of a carboxylic acid, wherein the carboxylic acid is selected from those carboxylic acids that, below a first temperature, have a greater water solubility than the water solubility of its corresponding alkali-metal salt. As will be discussed below, the first temperature is from about 15° C. to about 40° C.

Preferably, the agglomerated detergent powder of the present invention comprises from about 5% to about 80% sodium carbonate, from about 5% to about 50% of a nonionic detergent surfactant, wherein the nonionic surfactant is the sole detergent surfactant present, and from about 4% to about 18% of the sodium citrate, sodium malate, and mixtures thereof.

More preferably, the agglomerated detergent powder of the present invention comprises from about 20% to about 70% of sodium carbonate, from about 20% to about 40% of a nonionic detergent surfactant wherein the nonionic surfactant is the sole detergent surfactant present; and from about 5% to about 13% of a substantially completely neutralized carboxylic acid selected from the group consisting of sodium citrate, sodium malate, and mixtures thereof, wherein the sodium citrate or sodium malate is formed by the reaction, upon the addition of water, between a premix comprising (a) the nonionic surfactant and sodium carbonate and (b) admixed citric acid, malic acid, or mixtures thereof.

The term "coated" is used in the specification and claims to mean that the surfactant is present on the surface of the carbonate (and other particles) as well as within the carbonate (and other particles), e.g. by absorption.

Preferably, the process includes mixing sodium carbonate (and, optionally, other detergent ingredients) and a nonionic surfactant to form a homogeneous nonionic surfactant coated sodium carbonate premix, wherein the nonionic surfactant is the sole surfactant present in the premix a carboxylic acid selected from the group consisting of citric acid, malic acid, and mixtures thereof is admixed with the premix to form a mixture. The mixture is agitated while water is incorporated into the mixture causing the carboxylic acid to solubilize and neutralize to form the sodium salt of the carboxylic acid and to cause the mixture to agglomerate. The agglomerated mixture is dried to form a free-flowing powder detergent composition.

The term "free water" is used in the following specification and claims to indicate water that is not firmly bound as water of hydration or crystallization to inorganic materials.

Unless specifically noted, all percentages used in the following specification and claims are by weight of the final product.

DETAILED DESCRIPTION OF THE INVENTION AND PREFERRED EMBODIMENTS

The present invention provides a free-flowing agglomerated detergent powder that contains a high level of surfactant, particularly a nonionic surfactant.

The present invention also provides for a process for making a free-flowing agglomerated detergent powder that contains a high level of surfactant particularly a nonionic surfactant. The method includes loading an alkali metal carbonate (and, optionally, other detergent ingredients) with a surfactant to form a premix comprising a homogeneous mixture of surfactant coated carbonate. A carboxylic acid is admixed with the premix to form a mixture. The carboxylic acid is preferably selected from those carboxylic acids that, below a first temperature, have a water solubility that is greater than the water solubility of its corresponding alkali-metal salt. The mixture is introduced into a mixer, preferably a rotating drum agglomerator, where water is introduced to the mixture causing the carboxylic acid to solubilize and react with the alkali metal carbonate to form the alkali metal salt of the carboxylic acid at a temperature lower than the first temperature and to cause the mixture to agglomerate into particles. The particles are dried and sized.

The detergent composition comprises three essential ingredients: an alkali metal carbonate, a nonionic surfactant and a substantially completely neutralized carboxylic acid.

The alkali metal carbonate is preferably sodium carbonate for reasons of cost and efficiency. Among the preferred sodium carbonates used in the following examples are light density (LT) soda ash (Solvay process), mixtures of light density (LT) and medium density soda ash (Sesquicarbonate process), a special high porosity "medium-light" ash (Sesquicarbonate process) and mixtures of light density and "medium-light" ash. These particles of sodium carbonate have an average density of from about 0.5 to about 0.7 and an average mesh size ranging from about 20 to about 200, U.S. Standard Sieve number. Carbonates such as these are commercially available from FMC Corp. and General Chemical and are relatively inexpensive as compared to more processed carbonates because they do not require further processing such as grinding.

The sodium carbonate can be present in the free-flowing detergent composition in the amount of about 5% to about 80% by weight of the final product. The amount of sodium carbonate added to the final product is balanced against the amount of nonionic surfactant which will be loaded into the sodium carbonate as well as the amount which will be neutralized by the admixed carboxylic acid. The preferred range for the sodium carbonate is from about 20% to about 70%, more preferably from about 30% to about 65% by weight of the final product. It should be mentioned that within the preferred range the higher levels tend to be required under conditions of use at low product concentrations, as is commonly the practice in North America, and the converse applies under conditions of use at higher product concentrations, as tends to occur in Europe.

If desired, the alkali metal carbonate can be mixed with other minor amounts, not to exceed about 10% of the final product, of detergent ingredients before the nonionic surfactant is added to it. Alternatively, the nonionic surfactant can be added to other minor amounts of detergent ingredients, not to exceed about 10% of the final product, after which they can be mixed with the nonionic surfactant coated alkali metal carbonate. In one embodiment, the carbonate, optional detergent ingredients, and surfactant are mixed in the manner fully disclosed in U.S. Pat. No. 5,458,769 or 5,496,486, the entire disclosure of both are incorporated herein by reference.

In another embodiment, a minor amount, up to about 5%, of a silica such as a silicon dioxide hydrate is mixed with the alkali metal carbonate prior to loading with the nonionic surfactant. A variety of siliceous substances are acceptable for addition to the detergent composition, although highly absorbent silica of the precipitated or fumed variety is preferred. The preferred siliceous compounds have oil absorption numbers of 150 to about 350 or greater, preferably about 250 or greater. As examples of operable silicas, the following siliceous material are representative: Sipernat 50, Syloid 266, Cabosil M-5, Hisil 7–600. Preferably, from about 0.5% to about 4% by weight of the final product, of silica is mixed with the alkali metal carbonate prior to loading by the nonionic surfactant. More preferably, from about 3% to about 4% of silica by weight of the final product is mixed with the alkali metal carbonate.

Low levels of carboxymethylcellulose, for example from about 0.1% up to about 5%, to aid in the prevention of soil suspended in the wash liquor from depositing onto cellulosic fabrics such as cotton, may also be mixed with the alkali metal carbonate prior to loading with the nonionic surfactant. Preferably, from about 1% to about 3%, more preferably from about 2% to about 3% of carboxymethylcellulose is mixed with the alkali metal carbonate prior to loading with the nonionic surfactant. In a preferred embodiment, both the silica and the carboxymethylcellulose are mixed with the sodium carbonate prior to being loaded with the nonionic surfactant.

The second essential ingredient is a detergent surfactant and is selected from the group consisting of anionics, nonionics, zwitterionics, ampholytics, cationics, and mixtures thereof. The detergent surfactant used in the present invention may be any of the conventional materials of this type which are very well known and fully described in the literature, for example in "Surface Active Agents and Detergents" Volumes I and II by Schwartz, Perry & Berch, in "Nonionic Surfactants" by M. J. Schick, and in McCutcheon's "Emulsifiers & Detergents," each of which are incorporated herein in their entirety by reference. The surfactant is present at a level of from about 1% to about 90%. Desirably, the surfactant is present at a level of from about 10% to about 50%, and preferably, the surfactant is included in an amount from about 20% to about 40%.

Useful anionic surfactants include the water-soluble salts of the higher fatty acids, i.e., soaps. This includes alkali metal soaps such as the sodium, potassium, ammonium, and alkyl ammonium salts of higher fatty acids containing from about 8 to about 24 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 8 to about 20 carbon atoms and a sulfonic acid or sulfuric acid ester group. Included in the term "alkyl" is the alkyl portion of acyl groups. Examples of this group of synthetic surfactants are the sodium and potassium alkyl sulfates, especially those obtained by sulfating the higher primary or secondary alcohols ($C_8$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. No. 2,220,099 and alkylbenzene sulfonates in which the average number of carbon atoms in the alkyl group is from about 11 to 14, abbreviated as $C_{11-14}$ LAS.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

Other anionic surfactants that may be useful in the present invention include the secondary alkyl sulfates having the general formula

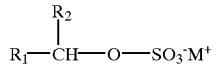

wherein M is potassium, sodium, calcium, or magnesium, $R_1$, represents an alkyl group having from about 3 to about 18 carbon atoms and $R_2$ represents an alkyl group having from about 1 to about 6 carbon atoms. Preferably, M is sodium, $R_1$ is an alkyl group having from about 10 to about 16 carbon atoms, and $R_2$ is an alkyl group having from about 1 to about 2 carbon atoms.

Other anionic surfactants useful herein are the sodium alkyl glycerol ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl group contains from about 10 to about 20 carbon atoms.

The ether sulfates useful in the present invention are those having the formula $RO(C_2H_4O)_xSO_3M$ wherein R is alkyl or alkenyl having from about 10 to about 20 carbon atoms, x is 1 to 30, and M is a water-soluble cation preferably sodium. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Another example of anionic surfactants that may be useful in the present invention are those compounds that contain two anionic functional groups. These are referred to as di-anionic surfactants. Suitable di-anionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyidisulfates.

The nonionic detergent surfactant may be any of the conventional materials of this type which are very well known and fully described in the literature, for example in "Surface Active Agents and Detergents" Volumes I and II by Schwartz, Perry & Berch, "Nonionic Surfactants" by M. J. Schick, and McCutcheon's "Emulsifiers & Detergents," each incorporated herein by reference. For example, the nonionic materials may include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Other useful nonionic surfactants include the polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty add (derived from coconut oil) which contains an average of about 12 carbon atoms, "tallow" fatty acids (derived from tallow-class fats) which contain an average of about 18 carbon atoms, palmitic acid, myristic acid, stearic acid and lauric acid.

The nonionic surfactants can also include polyoxyethylene or polyoxypropylene condensates of aliphatic alcohols, whether linear or branched chain and unsaturated or saturated, containing from about 8 to about 24 carbon atoms and incorporating from about 5 to about 50 ethylene oxide or propylene oxide units. Suitable alcohols include the coconut fatty alcohol, tallow fatty alcohol, lauryl alcohol, myristyl alcohol, and oleyl alcohol.

Alkyl saccharides may also find use in the composition. In general, the alkyl saccharides are those having a hydrophobic group containing from about 8 to about 20 carbon atoms, preferably from about 10 to about 16 carbon atoms, and a polysaccharide hydrophillic group containing from about 1 (mono) to about 10 (poly), saccharide units (e.g., galactoside, glucoside, fructoside, glucosyl, fructosyl, and/or galactosyl units). Mixtures of saccharide moieties may be used in the alkyl saccharide surfactants. Preferably, the alkyl saccharides are the alkyl glucosides having the formula $$R^1O(C_nH_{2n}O)_t(Z)_x$$

wherein Z is derived from glucose, $R^1$ is a hydrophobic group selected from the group consisting of alkyl, alkylphenyl, hydroxyalkyl, hydroxyalkylphenyl, and mixtures thereof in which the alkyl groups contain from about 10 to about 18 carbon atoms, n is 2 or 3, t is from 0 to about 10, and x is from 1 to about 8. Examples of such alkyl saccharides are described in U.S. Pat. No. 4,565,647 (at col. 2, line 25 through col. 3, line 57) and U.S. Pat. No. 4,732,704 (at col. 2, lines 15–25), the pertinent portions of each are incorporated herein by reference.

Semi-polar nonionic surfactants include water-soluble amine oxides containing one alkyl moiety of from about 10 to 18 carbon atoms and two moieties selected from the group of alkyl and hydroxy alkyl moieties of from about 1 to about 3 carbon atoms; water-soluble phosphine oxides containing one alkyl moiety of about 10 to 18 carbon atoms and two moieties selected from the group consisting of alkyl groups and hydroxy alkyl groups containing from about 1 to 3 carbon atoms; and water-soluble sulfoxides containing one alkyl moiety of from about 10 to 18 carbon atoms and a moiety selected from the group consisting of alkyl and hydroxy alkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent. Cationic surfactants comprise a wide variety of compounds characterized by one or more organic hydrophobic groups in the cation and generally by a quatemary nitrogen associated with an acid radical. Pentavalent nitrogen ring compounds are also considered quatemary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

The ethoxylated alkyl phenols with $C_8$–$C_{16}$ alkyl groups, preferably $C_8$–$C_9$ alkyl groups and from about 4–12 EO units per molecule, or ethoxylated fatty acid amides may be used. Other nonionic detergent compounds which can be used for the purposes of the present invention will be readily apparent to those skilled in the art. It will be appreciated that the nonionic compounds which are used to the greatest benefit are liquid compounds which are more difficult to incorporate into detergent compositions otherwise, though pasty or solid nonionic detergent compounds may also be used. In the latter case, adsorption of the nonionic compound onto the calcium carbonate may be facilitated by the use of elevated temperatures.

Preferably, the nonionic surfactant is a polyoxyethylene or polyoxypropylene condensate of an aliphatic alcohol, whether linear- or branched-chain and unsaturated or saturated, containing from about 8 to about 24 carbon atoms and incorporating from about 5 to about 50 ethylene oxide or propylene oxide units. The nonionic detergent compounds of most commercial interest and which are most readily available include the ethoxylated synthetic or natural fatty alcohols, preferably linear primary or secondary monohydric alcohols with $C_8$–$C_{18}$, preferably $C_{10}$–$C_{16}$, alkyl groups and about 3–80, preferably 5–20, ethylene oxide (EO) units per molecule.

Examples of the preferred nonionic surfactant compounds in this category are the nonionic surfactants having the formula $R^1(OC_2H_4)_nOH$, where $R^1$ is a $C_8$–$C_{16}$ alkyl group or a $C_8$–$C_{12}$ alkyl phenyl group, and n is from 3 to about 80. Particularly preferred nonionic surfactants are the condensation products of $C_8$–$C_{16}$ alcohols with from about 5 to about 20 moles of ethylene oxide per mole of alcohol, e.g., a $C_{12}$–$C_{16}$ alcohol condensed with about 5 to about 9 moles of ethylene oxide per mole of alcohol. Nonionic surfactants of this type include the NEODOL™ products, e.g., Neodol 23-6.5, Neodol 25-7, and Neodol 25-9 which are respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

The amount of a surfactant particularly a liquid nonionic surfactant that can be adsorbed on the alkali metal carbonate to give a free flowing product is generally up to about 50% by weight of the resultant product. Although higher levels of nonionic detergent surfactants can be used if desired, this tends to defeat the object of the present invention because the resultant product is a paste or a powder with poor flow properties. On the other hand, with very low levels of less than, say, about 5% of the nonionic detergent compound, there is clearly little benefit achieved.

Desirably, the ratio of alkali metal carbonate to nonionic surfactant is from about 2:1 to about 3.5:1. Within this range of ratios, it is believed that an effective cleaning free-flowing powder can be produced. Preferably, the ratio is from about 2.2:1 to about 3.3:1, more preferably from about 2.3:1 to about 2.8:1. In the most preferred embodiment the ratio of alkali metal carbonate to nonionic surfactant is about 2.4:1.

Preferably, the surfactant is a nonionic surfactant which is incorporated in an amount of about 5% to about 50% by weight of the final product. Of course, the detergent benefits of high nonionic concentration must be balanced against cost-performance. Therefore, the preferred range for the nonionic surfactants is from about 20% to about 40% by weight of the final product, more preferably, from about 20% to about 30%. Most preferably, the nonionic surfactant is present at a level of about 25%. It should be mentioned that within the above ranges the lower levels tend to be required under conditions of use at higher product concentrations, as is commonly the practice in Europe, and the converse applies under conditions of use at lower product concentrations, as tends to occur in North America and Asia.

Loading, adsorption, and absorption of the nonionic surfactant onto the alkali metal carbonate (and into its porous structure) can be achieved by simple admixture with sufficient agitation to distribute the nonionic compound entirely on the alkali metal carbonate to form a premix comprising a homogeneous mixture of nonionic surfactant coated alkali metal carbonate. The loading can be accomplished in any of the known mixers such as by a ribbon or plow blender. Preferably, the nonionic surfactant is sprayed onto the alkali metal carbonate and other optional ingredients, if present, while they are agitated. In preparing the premix of the present invention, it is important that the alkali metal carbonate is sufficiently coated with the nonionic surfactant so that when water is later added, the water does not immediately contact uncoated carbonate and hydrate the carbonate. It is believed that excessive hydration of the carbonate reduces the amount of water available to solubilize the carboxylic acid which will require additional water to achieve the desired agglomerated particle size.

At the same time, if an excess amount of nonionic surfactant is present in the premix, the later admixed carboxylic acid may be coated with the excess nonionic surfactant. As a result, the amount of carboxylic acid available to solubilize and neutralize with the alkali metal carbonate will be reduced, which, in turn will reduce the agglomeration efficiency and require additional carboxylic acid to achieve the desired particle size.

In the preferred embodiment of the present invention, from about 5% to about 80% sodium carbonate is blended with from about 5% to about 50% of a nonionic surfactant, wherein the nonionic surfactant is the sole surfactant present to form a form a premix comprising a homogeneous mixture of nonionic surfactant coated alkali metal carbonate. More preferably, the premix is formed by blending from about 20% to about 70% of sodium carbonate with up to about 5%, preferably from about 2% to about 4% of silica, and from about 1 % to about 3% of minor detergent ingredients including carboxymethylcellulose and, loading the sodium carbonate, silica, and carboxymethylcellulose with from about 20% to about 40% of a nonionic surfactant wherein the nonionic surfactant is the sole surfactant present in the premix. In a more preferred embodiment, the premix is formed by mixing from about 30% to about 65% of sodium carbonate, from about 0.5% to about 4% of a silica, from about 2% to about 3% of carboxymethylcellulose, and a minor amount of other optional detergent ingredients; and spraying from about 20% to about 30% of a nonionic surfactant wherein the nonionic surfactant is the sole detergent surfactant present, onto the mixed carbonate, silica, carboxymethylcellulose, and optional ingredients.

As discussed above, the surfactant, particularly the nonionic surfactant is added in an amount so that it is within a particular ratio with respect to the sodium carbonate. Within this ratio range, the surfactant adequately coats the sodium carbonate yet does not provide a substantial excess of surfactant which would then undesirably coat the carboxylic acid. Moreover, it is believed that the order of addition is important to achieving the desired agglomeration. By loading the alkali metal carbonate with the surfactant prior to the admixture of carboxylic acid and introduction of water, the desired particle size is achieved while still producing a free-flowing powder.

The third essential ingredient in the free-flowing agglomerated powder detergent composition of the present invention is the alkali metal salt of a carboxylic acid wherein the carboxylic acid is selected from those carboxylic acids that, below a first temperature, have a greater water solubility than the water solubility of its corresponding alkali-metal salt. Preferably, the alkali metal carboxylate is provided solely by the reaction of the corresponding carboxylic acid and the alkali metal carbonate. Preferred alkali metal carboxylates are selected from the group consisting of alkali metal citrate, alkali metal malate, and mixtures thereof. Alkali metal citrate is the most preferred because citric acid is relatively inexpensive and is readily obtainable. In the preferred embodiment where the alkali metal carbonate is sodium carbonate, the alkali metal carboxylate is selected from the group consisting of sodium citrate, sodium malate, and mixtures thereof.

The alkali metal carboxylate is present in the detergent composition at a level of up to about 25%, preferably from about 4% to about 18% and is provided solely by the reaction of the carboxylic acid corresponding to the alkali metal carboxylate, and the alkali metal carbonate. It is believed that when the amount of alkali metal carboxylate is within this range, the desired agglomeration of the nonionic surfactant loaded alkali metal carbonate will be efficiently achieved and will produce the desired particle size. More preferably, the alkali metal carboxylate is present at a level of from about 5% to about 13% and in the most preferred embodiment is present at a level of about 9% to about 11%.

Desirably, as will be further discussed below, the carboxylic acid should be substantially completely neutralized by reaction with the alkali metal carbonate to its corresponding alkali metal salt during processing. For example, malic acid should be substantially completely neutralized to an alkali metal malate. Because of reaction and processing limitations, it is believed that the carboxylic acid is not completely neutralized. Therefore, it is desirable to neutralize at least about 90%, preferably at least about 95% and more preferably at least about 99% of the carboxylic acid to its alkali metal carboxylate. Preferably, the substantially completely neutralized carboxylic acid will be selected from the group consisting of the alkali metal salts of citric acid, malic acid, and mixtures thereof. In the preferred embodiment where the alkali metal carbonate is sodium carbonate, the substantially completely neutralized carboxylic acid is selected from the group consisting of sodium citrate, sodium malate, and mixtures thereof.

The amount of carboxylic acid to be admixed can be determined from the amount of substantially completely neutralized carboxylic acid desired in the final product as well as the amount of alkali metal carbonate present. It would be desirable to use the minimum amount of carboxylic acid necessary to achieve acceptable agglomeration. This amount, however, must be balanced against the desire to provide an amount of the alkali metal carboxylate in the final product sufficient to control hard water filming in those instances where hard water is used. Acid levels which are too high can result in lower alkalinity by neutralization of the alkali metal carbonate which can detrimentally affect detergent performance. Too little acid, on the other hand, reduces the ability of the acid salt hydrate to entrap the added moisture and hampers agglomeration. The carboxylic acid is therefore incorporated in an amount such that the ratio between the alkali metal carbonate and the carboxylic acid is in the range from about 6.5:1 to about 12:1, preferably in the range from about 6.5:1 to about 8:1, more preferably about 7:1.

The carboxylic acid is admixed with the premix at a level of up to about 18% by weight of the final product. The preferred range of admixed acid is from about 3% to about 13% by weight of the final product, more preferably from about 4% to about 10% and most preferably from about 7% to about 9%. The carboxylic acid is only lightly admixed with the premix prior to the later introduction of water to minimize the potential for coating of the carboxylic acid by the nonionic surfactant.

After the carboxylic acid is lightly admixed with the premix, a small amount of water is incorporated to accomplish agglomeration of the particles. The water may be incorporated as a mist, steam, or in another suitable fashion. Desirably, the amount of water used is as small as practical in order to minimize subsequent drying time, energy and thus cost. The water is therefore incorporated at a level from about 0.1% to no more than about 7%, preferably no more than about 5%. In a more preferred embodiment, the water is incorporated in a range between about 4% and about 5%.

The water is incorporated into the mixture using any suitable mixing apparatus to achieve agglomeration of the mixture. Preferably, a drum agglomerator is used. The agglomerator rotates to distribute the mixture along the length of the drum as the falling sheets of the mixture are sprayed with water to produce a well controlled agglomeration of the particles.

Without wishing to be bound by any particular theory, it is believed that the carboxylic acid is solubilized and neutralized by the alkali metal carbonate at the same time the alkali metal carbonate is hydrated. The carboxylic acid should be substantially completely neutralized to its corresponding alkali metal salt which, below a first temperature, is less water soluble than the acid form. During the neutralization of the carboxylic acid, the alkali metal carboxylate binds the surfactant coated alkali metal carbonate particles to agglomerate them and to produce the desired particle size. As the drum rotates and the particles are agglomerated, the larger particles move from the inlet end to the outlet end of the agglomerator where they exit and are conveyed to a dryer to remove the free water from the agglomerated particles. The agglomerator is preferably inclined from the inlet to the outlet so that as the particles agglomerate, the larger agglomerated particles move from the inlet end to the outlet end where they are dried.

In particular, while not wishing to be held to a specific theory, it is believed that the carboxylic acid is solubilized with the water and reacts with the alkali metal carbonate to become substantially completely neutralized. The salts of the carboxylic acids, for example, citric and malic, have a water solubility less than their acid form below a first temperature and therefore the salts come out of solution to bind and thus agglomerate the particles. As noted above, insufficient coating by the surfactant on the surface of the alkali metal carbonate will produce excessive hydration of the sodium carbonate. As a result, the water required to solubilize the carboxylic acid will not be available and additional water and processing time will be required to produce the desired agglomerated particle size. In addition, hydration of sodium carbonate is exothermic and excessive hydration of sodium carbonate will generate undesirable heat and increase the temperature of the mixture above the first temperature. At the same time, an excess of surfactant present in the premix may cause coating of the carboxylic acid resulting in a reduction of agglomeration efficiency. In addition, additional carboxylic acid and water may be required to achieve the desired agglomerated particle size. Consequently, the order of addition as well as the temperature are believed to be important to achieving the desired agglomeration and particle size.

It is believed that by adding the carboxylic acid after the premix has been formed, the desired solubilization of the carboxylic acid is achieved prior to a substantial reaction with the alkali metal carbonate. If the citric acid were admixed with the alkali metal carbonate prior to adding the surfactant, it is believed that the resulting product would not achieve the desired free flowing and dissolution properties.

As noted above, the preferred carboxylic acid has a greater water solubility than its corresponding alkali metal salt below a first temperature. An increase in temperature above the first temperature therefore adversely affects the relative solubility of the acid form of the carboxylic acid in comparison to the salt form which, in turn, adversely affects the agglomeration efficiency. As a result, the formation of the alkali metal salt of the carboxylic acid is controlled so as to prevent the temperature of the mixture from rising above the first temperature.

Generally, the first temperature can range from about 15° C. to about 40° C., preferably from about 32° C. to about 35° C. A first temperature higher than about 42° C. appears to adversely affect the product characteristics and is, therefore, undesirable.

It will be understood by one skilled in the art that several factors can be varied to control the residence time (i.e., the weight of the mixture on the bed divided by the total feed rate) and agglomerate size, e.g., feed rate to the drum, angle of the drum, rotational speed of the drum, the number and location of the water spray. The result of manipulating such factors is desired control of the particle size and density of the agglomerates.

The wetted agglomerated particles are dried to remove any free water. The drying may be accomplished by any known method such as by a tumbling dryer or air drying on a conveyor. As one skilled in the art will appreciate, the time, temperature, and air flow may be adjusted to provide for an acceptable drying rate. Using a high ambient temperature in the dryer can shorten the residence time in the dryer, while lower temperatures may unduly lengthen the residence time. Short residence times, however, may increase the risk of adversely affecting the stability of the agglomerates or of incompletely drying the agglomerate.

It is desirable to remove as much water as practicable since the presence of water, even when bound, may detrimentally react with post-added moisture sensitive detergent ingredients such as bleaches and enzymes. In addition, the presence of water may, over time and under typical storage conditions, cause product caking. Therefore, in a preferred embodiment, a minor amount of water is added to accomplish agglomeration and furthermore, at least about 50% of the added water is removed by drying. More preferably, at least about 60% of the added water is removed by drying. Consequently, the resulting composition contains less than about 3% of bound water, more preferably less than about 2% of bound water.

The dried particles have an average particle mesh size of up to about 20 U.S. Standard Sieve number. Preferably, the particles have a particle mesh size such that about 90% of the particles are in the range from about 20 to about 100 U.S. Standard Sieve number. The resulting powder has a bulk density of at least 0.7 g/cc, preferably from about 0.8 to about 0.9 g/cc, more preferably from about 0.85 to about 0.9 g/cc.

The mixing steps in the process to prepare the detergent compositions of this invention can be accomplished with a variety of mixers known in the art. For example, simple, paddle or ribbon mixers are quite effective although other mixers, such as drum agglomerators, fluidized beds, pan agglomerators and high shear mixers may be used.

The preferred embodiment of the agglomerated detergent composition of the present invention includes from about 20% to about 70% of sodium carbonate, from about 20% to about 40% of a surfactant, particularly a nonionic detergent surfactant and from about 3% to about 13% of a sodium carboxylate selected from the group consisting of sodium citrate, sodium malate, and mixtures thereof, wherein the sodium carboxylate is provided solely by the reaction, at a temperature, below a first temperature, or (a) a premix comprising a surfactant and sodium carbonate, (b) a carboxylic acid selected from the group consisting of citric acid, malic acid, and mixtures thereof, and (c) water.

Preferably, the agglomerated detergent composition resulting from the process of the present invention includes from about 20% to about 70% of sodium carbonate, from about 20% to about 40% of a nonionic detergent surfactant, wherein the nonionic surfactant is the sole detergent surfactant present, and from about 4% to about 18% of a sodium salt of a carboxylic acid selected from the group consisting of sodium citrate, sodium malate, and mixtures thereof, wherein the sodium salt of the carboxylic acid is formed by the reaction at a temperature below a first temperature of (a) a premix comprising a nonionic surfactant loaded sodium carbonate, (b) a carboxylic acid selected from the group consisting of citric acid, malic acid, and mixtures thereof, and (c) water.

In addition to the essential ingredients mentioned above, it is possible to include in the detergent composition of the invention other conventional detergent additives. Examples of such optional additives are lather boosters such as alkanolamides, particularly the monoethanolamides derived from palm kernel fatty acids and coconut fatty acids, lather depressants such as alkyl phosphates and silicone oils, anti-redeposition agents such as sodium carboxymethyl cellulose, oxygen releasing bleaching agents such as sodium perborate and sodium percarbonate, peracid bleach precursors, chlorine releasing bleaching agents such as trichloroisocyanuric acid and alkali metal salts of dichloroisocyanuric acid, fabric softening agents, inorganic salts such as sodium sulfate, anti-tarnish and anticorrosion agents, soil suspending agents, soil release agents and, usually present in very minor amounts, fluorescent agents, perfumes, enzymes, enzyme stabilizing agents and germicides. These optional additives may be added when convenient during or after, preferably after, the drying of the detergent compositions of the present invention. Such ingredients are described in U.S. Pat. No. 3,936,537, incorporated herein by reference.

A low level of silicate, for example up to about 5% by weight, is usually advantageous in decreasing the corrosion of metal parts in fabric washing machines. Useful silicates such as an alkali metal silicate, particularly sodium neutral, alkaline, meta- or orthosilicate can be used.

Water-soluble, organic builders may also find use in the detergent composition of the present invention. For example, the salts of ethylenediaminetetraacetic acid, nitrilotriacetic acid, oxydisuccinic acid, mellitic acid, benzene polycarboxylic acid, polyacrylic acid, and polymaleic acid may be included.

Aluminosilicate ion exchange materials may be useful in the detergent composition of this invention and may include the naturally-occurring aluminosilicates or synthetically derived. a method for producing aluminosilicate ion exchange materials is discussed in U.S. Pat. No. 3,985,669, incorporated herein by reference. Such synthetic crystalline aluminosilicate ion exchange materials are available under the designations Zeolite A, Zeolite B, and Zeolite X. In addition, layered or structured silicates such as those sold under the designation SKS-6 by Hoechst-Celanese may also find use in the detergent composition.

Bleaching agents and activators that may find use in the present detergent composition are described in U.S. Pat. Nos. 4,412,934, and 4,483,781, both of which are incorporated herein by reference. Suitable bleach compounds include sodium perborate, sodium percarbonate, etc. and the like, and mixtures thereof. The bleach compounds may also be used in combination with an activator such as, for example, tetra-acetyl-ethylenediamine (TAED), sodium nonanoyloxybenzene sulfonate (SNOBS), diperoxydodecanedioc acid (DPDDA) and the like, and mixtures thereof. Chelating agents are described in U.S. Pat. No. 4,663,071, from column 17, line 54 through column 18, line 68, incorporated herein by reference. Suds modifiers are also optional ingredients and are described in U.S. Pat. Nos. 3,933,672, and 4,136,045, both incorporated herein by reference.

Smectite clays may be suitable for use herein and are described in U.S. Pat. No. 4,762,645, at column 6, line 3 through column 7, line 24, incorporated herein by reference. Other suitable additional detergency builders that may be used herein are enumerated in U.S. Pat. No. 3,936,537, column 13, line 54 through column 16, line 16, and in U.S. Pat. No. 4,663,071, both incorporated herein by reference.

In addition, whitening agent particles may be added to the dried powder detergent described above. The whitening agent particles comprise a fluorescent whitening agent and an anionic surfactant that substantially protects the whitening agent from degradation caused by the presence of nonionic surfactant. The preferred whitening agent particle composition and method of making it more fully described in U.S. patent application Ser. No. 08/616,570 now U.S. Pat. No. 5,714,452 and U.S. patent application Ser. No. 08/616,208 now U.S. Pat. No. 5,714,456, respectively, both of which are incorporated herein by reference.

The laundry detergent compositions of the present invention can be formulated to provide a pH (measured at a concentration of 1% by weight in water at 20° C.) of from about 7 to about 11.5. A pH range of from about 9.5 to about 11.5 is preferred for best cleaning performance.

The detergent composition may also contain a post-added acidulant for improved solubility, as more particularly described in U.S. application Ser. No. 08/617,941 now abandoned the entire disclosure of which is incorporated herein by reference.

The following examples are for illustrative purposes only and are not to be construed as limiting the invention.

EXAMPLE 1

The ingredients listed in Table 1 were agglomerated into an acceptable freeflowing powder detergent in the following manner. The sodium carbonate, whitener, silica, and carboxymethylcellulose were mixed for about 1 minute in a ribbon mixer to achieve a uniform mixture. Neodol 25-7 (a $C_{12}$–$C_{15}$ alcohol ethoxylated with 7 moles of ethylene oxide) was poured into the above mixture while mixing to uniformly coat the sodium carbonate and other ingredients. The loaded sodium carbonate (and other ingredients) were transferred to a laboratory scale agglomerator (O'Brien Industrial Equip. Co., 3 foot diameter, 1 foot long) which was rotated at about 9 rpm for about 2 minutes after which water was sprayed on the mixture to cause agglomeration of the particles. Thereafter, the mixture was dried to a moisture content of about 2.15. The resulting composition had a bulk density of 0.85 and had a Flodex value of 12 as tested in a Model No. 211, Hansen Research Corp. Flodex testing apparatus.

TABLE 1

| Material | Amount (weight %) |
|---|---|
| Sodium Carbonate (FMC Grade 90) | 55.88 |
| Brightener (Tinopal SWN) | 0.02 |
| Silica (Sipernat 50) | 3.0 |
| Carboxymethylcellulose | 2.0 |
| Neodol 25-7 | 22.0 |
| Citric Acid | 7.5 |
| Water (added) | 4.0 |
| Water (after drying) | 1.5 |
| Post-added fumaric acid | 5.0 |
| Post-added ingredients (fragrance, enzyme whitener) | 3.1 |

EXAMPLES 2–4

The following ingredients were agglomerated in the same fashion as described in Example 1, above, with the results also shown in Table 2.

TABLE 2

| Material | Amount (Formula Weight) | | |
|---|---|---|---|
| Example No. | 2 | 3 | 4 |
| Sodium Carbonate | 55.88 | 55.88 | 53.18 |
| Silica | 3.0 | 3.0 | 3.0 |
| Carboxymethylcellulose | 2.0 | — | 2.0 |
| Brightener | 0.02 | 0.02 | 0.02 |
| Citric Acid | 7.5 | 7.5 | 7.5 |
| Water (added for agglomeration) | 4.0 | 4.0 | 4.0 |
| Water (after drying) | 2.2 | 1.2 | 1.2 |
| Density | 0.85 | 0.87 | 0.84 |
| Flodex | 12 | 9 | 10 |

EXAMPLES 5–6

Table 3 lists typical amounts of ingredients useful to make a free-flowing nonionic surfactant detergent according to the present invention. The sodium carbonate, silica, and carboxymethylcellulose can be mixed and, while mixing, the nonionic surfactant can be sprayed onto the mixture to coat the mixture. The citric acid can then mixed and, while mixing, water can be sprayed onto the mixture to cause the particles to agglomerate. The agglomerated particles can be dried. Thereafter, any post-added optional ingredients like enzymes, fragrances, and the like can be added as well as an acidulant such as fumaric acid.

TABLE 3

| Materials | Amount (Weight %) | |
|---|---|---|
| Example No. | 5 | 6 |
| Sodium Carbonate | 59.6 | 53.2 |
| Silica | 3.0 | 3.0 |
| Carboxymethylcellulose | 2.2 | 2.0 |
| Pareth 25-7 | 24.7 | 22.0 |
| Citric Acid | 8.4 | 7.5 |
| Water (after drying) | 2.1 | 1.5 |
| Optional Minor Ingredients | — | 5.8 |
| Post-added fumaric acid | — | 5.0 |

It should be understood that a wide range of changes and modifications can be made to the embodiments described above. It is therefore intended that the foregoing description illustrates rather than limits this invention, and that it is the following claims, including all equivalents, which define this invention.

What is claimed is:

1. A process for producing a free-flowing agglomerated powder detergent composition comprising the steps of:

a. preparing a homogeneous surfactant coated alkali metal carbonate premix comprising:
   i. from about 5% to about 80% by weight of an alkali metal carbonate;
   ii. from about 5% to about 50% by weight of a detergent surfactant, wherein the detergent surfactant is selected from the group consisting of anionics, nonionics, zwitterionics, ampholytics, cationics, and mixtures thereof;

b. subsequently admixing a carboxylic acid with the premix to provide a mixture, wherein below a first temperature, which is less than about 42° C., the carboxylic acid has a greater water solubility than the water solubility of its corresponding alkali metal salt, the carboxylic acid being admixed in an amount up to about 18% by weight; and c. subsequently adding water to the mixture whereby the carboxylic acid solubilizes and reacts with the alkali metal carbonate below the first temperature.

2. The process of claim 1 wherein the alkali metal carbonate is sodium carbonate.

3. The process of claim 1 wherein the surfactant consists of a nonionic surfactant.

4. The process of claim 3 wherein the ratio of sodium carbonate to nonionic surfactant is in the range of about 2:1 to about 3.5:1.

5. The process of claim 1 wherein the carboxylic acid is selected from the group consisting of citric acid, malic acid, and mixtures thereof.

6. The process of claim 1 wherein the amount of the carboxylic acid is such that the ratio of the sodium carbonate to the carboxylic acid is from about 6.5:1 to about 12:1.

* * * * *